United States Patent [19]

Reid et al.

[11] Patent Number: 4,658,261

[45] Date of Patent: Apr. 14, 1987

[54] CIRCUMFERENTIAL SLOTTED RIDGED WAVEGUIDE ARRAY ANTENNA

[75] Inventors: Daniel G. Reid, Klamath Falls, Oreg.; C. Sterling Van Meter, Mt. View, Calif.

[73] Assignee: The United States of America as represented by the Secretary of the Navy, Washington, D.C.

[21] Appl. No.: 695,102

[22] Filed: Jan. 25, 1985

[51] Int. Cl.[4] ..... H01Q 13/10

[52] U.S. Cl. ..... 343/771

[58] Field of Search ..... 343/767–771, 343/789, 708, 705

[56] References Cited

U.S. PATENT DOCUMENTS

| | | | |
|---|---|---|---|
| 3,074,063 | 1/1963 | Horton | 343/708 |
| 3,172,113 | 3/1965 | Heinard et al. | 343/771 |
| 3,193,830 | 7/1965 | Provencher | 343/771 |
| 3,213,454 | 10/1965 | Ringenbach | 343/771 |
| 3,224,004 | 12/1965 | Barthez | 343/771 |
| 3,308,467 | 3/1967 | Morrison | 343/771 |
| 3,524,189 | 8/1970 | Jones, Jr. | 343/771 |
| 3,653,052 | 3/1972 | Campbell et al. | 343/708 |
| 3,990,079 | 11/1976 | Epis | 343/705 |
| 4,245,222 | 1/1981 | Eng et al. | 343/708 |

*Primary Examiner*—E. Lieberman
*Assistant Examiner*—Michael C. Wimer
*Attorney, Agent, or Firm*—R. F. Beers; C. D. B. Curry; W. C. Daubenspeck

[57] ABSTRACT

An antenna for providing a broadband omnidirectional circumferential radiation pattern is formed by an array of arcuate waveguide radiators arranged to form a cylindrical antenna. Each waveguide radiator has a ridged waveguide cavity and a plurality of longitudinally-oriented slots communicating with the waveguide cavity. The slots are arranged in two parallel rows on either side of the longitudinal centerline in a staggered relationship along the outside surface of the radiator. Each radiator is fed from the interior of the cylindrical array at a feed point located at the center of the radiator.

5 Claims, 11 Drawing Figures

CIRCUMFERENTIAL SLOTTED RIDGED WAVEGUIDE ARRAY ANTENNA

BACKGROUND OF THE INVENTION

This invention relates in general to waveguide antennas and, in particular, to a slotted waveguide array antenna providing a broadband omnidirectional circumferential radiation pattern. The invention relates especially to a cylindrical S-band antenna particularly suitable for use in telemetry and tracking applications in missiles.

In space applications such as missile telemetry and tracking, there is a need for an antenna that will provide broadband omnidirectional circumferential radiation patterns with a minimum of fluctuation in gain and phase. The antenna must satisfy severe size limitations and have a rugged construction capable of withstanding the expected spacecraft environments. The antenna is preferably capable of being mounted flush with the surface of the spacecraft so as not to increase the air drag and have a simple design facilitating construction, installation, and maintenance of the antenna. The present invention is intended to satisfy the foregoing requirements.

SUMMARY OF THE INVENTION

The present invention is an array of arcuate waveguide radiators arranged to form a cylindrical antenna. Each waveguide radiator has a ridged waveguide cavity and a plurality of longitudinally-oriented slots communicating with the waveguide cavity. The slots are arranged in two parallel rows on either side of the longitudinal centerline in a staggered relationship along the outside surface of the radiator. Each radiator is fed from the interior of the cylindrical array at a feed point located at the center of the radiator.

The advantages and features of the present invention will become apparent as the invention becomes better understood from the following description of a preferred embodiment when considered in conjunction with the accompanying drawings wherein:

DESCRIPTION OF A PREFERRED EMBODIMENT

Figure 1:
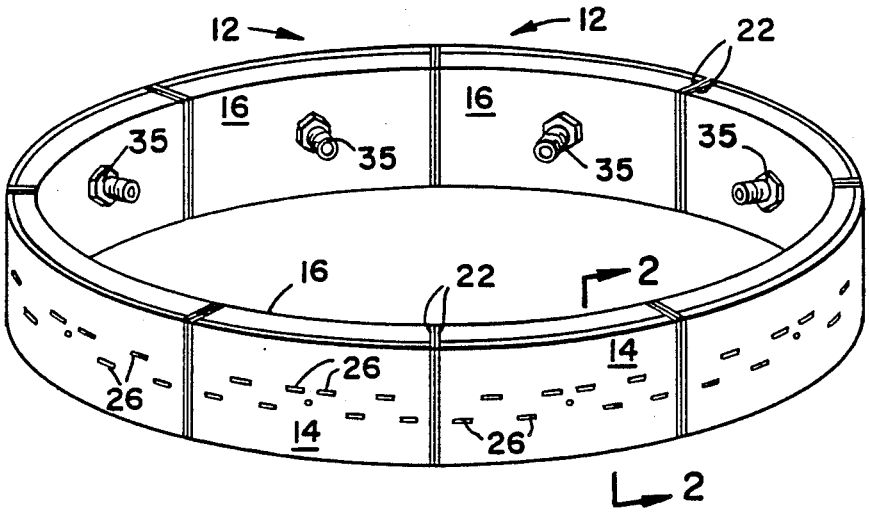
FIG. 1 is a perspective view illustrating an antenna according to the present invention.
Figure 2:
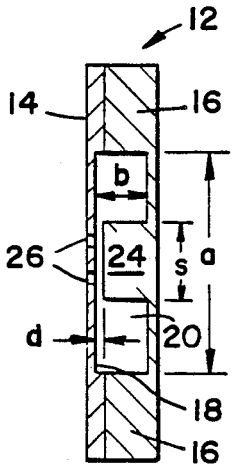
FIG. 2 is a cross-sectional view of an element of the antenna of FIG. 1 taken along 2—2.
Figure 3C:
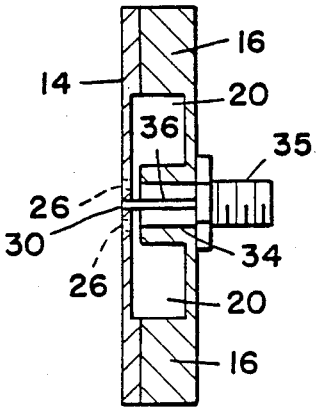
FIG. 3*c* is a cross-sectional view taken along line 3*c*—3*c* in FIG. 3*b;*
Figure 3A:
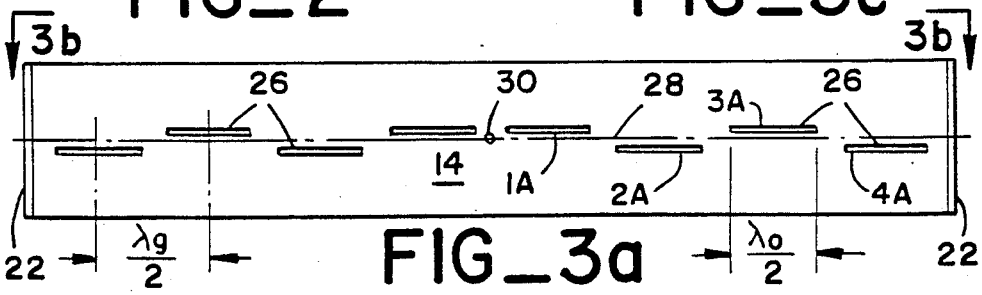
FIG. 3*a* is a side plan view of one element of the antenna of FIG. 1.
Figure 3B:
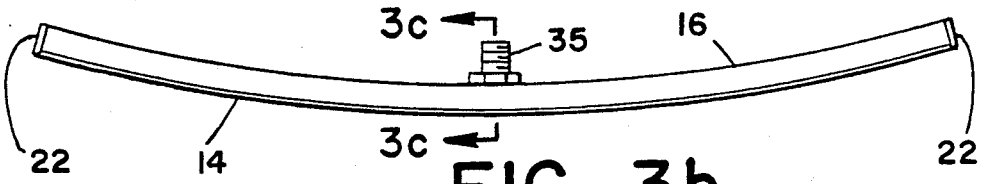
FIG. 3*b* is a top plan view of the element of FIG. 3*a;*

Referring now to the drawings and, in particular to FIGS. 1–3, the preferred embodiment of the circumferential slotted ridge waveguide array antenna comprises an array of eight radiators 12 forming a cylindrical antenna. Each arcuate radiator 12 includes a cover section 14 and a cavity section 16. A single ridged waveguide cavity is formed by a recess 18 in the cover section 14 and two parallel channels 20 in the cavity section 16. The ends of the waveguide cavity are enclosed by end caps 22. As shown in FIG. 2, the width and height of the cavity are identified by dimensions a and b, respectively. The central longitudinal ridge 24 has a width of dimension s and extends into the channel to provide a ridge gap of dimension d between the ridge and the cover section 14. The cover section 14, the cavity section 16 and the end caps 22 may conveniently be fixed securely together by screws or other fastening means (not shown).

A plurality of slots 26 communicating with the cavity are formed in the cover section 14. The slots 26 are arranged in two parallel rows which are equidistant from the longitudinal centerline 28 of the cover section 14. A feedpoint 30 is located at the midpoint of centerline 28. The location of the slots 26 on one side of the feedpoint 30 is symmetrical with the location of the slots on the other side and adjacent slots on each side of the feedpoint are disposed in alternate rows. The slots 26 are each nominally of a length slightly greater than one-half the wavelength ($\lambda o$) in air at the center operating frequency of the antenna and have rounded ends. Adjacent slots 26 are spaced center to center in the longitudinal plane, nominally at a distance equal to one-half of the wavelength ($\lambda g$) of the center operating frequency in the waveguide. The waveguide wavelength is selected based on the grating lobe desired. The dimensions and location of the slots relative to the longitudinal centerline 28 are chosen to provide proper impedance matching and output power coupling for the waveguide.

The cavity section 14 has a hole 34 located at its longitudinal and vertical midpoint to permit a feedprobe 36 from launcher 35 to be inserted from the center of the array through the cavity section to contact the cover section 14 at the feedpoint 30.

ILLUSTRATIVE EXAMPLE

FIGS. 4–9 illustrate the operation of an S-band antenna according to the present invention having an intended operating band of 2200–2290 MHZ. The S-band antenna is an eight-radiator array as shown in FIGS. 1–3 which has the following approximate dimensions. Designed for a specific missile telemetry application, the antenna array has an outside radius of 39.094 inches with each radiator 12 covering 43°44′ of arc and a gap of 1° (0.70 inches) of arc between radiators. The antenna has an outside circumference of 245.635 inches. Each radiator has an outside cover arc length of 30.704 inches and each cavity has an outside arc length of 29.844 inches.

The slots 26 are 2.82 inches in length 0.062 inches in width, and have centerlines located 0.135 inches above or below the longitudinal centerline 28 of the element. It was found that varying the length of the slots from the nominal length $\lambda o/2$ primarily influenced the voltage standing wave ratio (VSWR) of the antenna. The most efficient VSWR was provided when the slots were approximately 1.1 $\lambda o/2$ in length. The center to center spacing of the slots 26 in the longitudinal plane is chosen in view of the conventional 90% gain and associated grating lobe criteria that the spacing be less than $0.8\lambda o$.

The slots 26 are then spaced to have equal separation across the waveguide 12 without overlapping.

The dimensions of the waveguide cavity, which are chosen by conventional rectangular waveguide design principles, are 2.19 inches for the width (a), 0.535 inches for height (b), 0.800 inches for the ridge width (s), and 0.156 inches for the gap (d). The size of the ridge gap (d) was found to have a large influence on the operating bandwidth performance of the antenna. The preferred ridge gap (d) for broad bandwidth operation is obtained experimentally by varying the gap about the dimension predicted by the conventional waveguide design theory.

Figure 4:
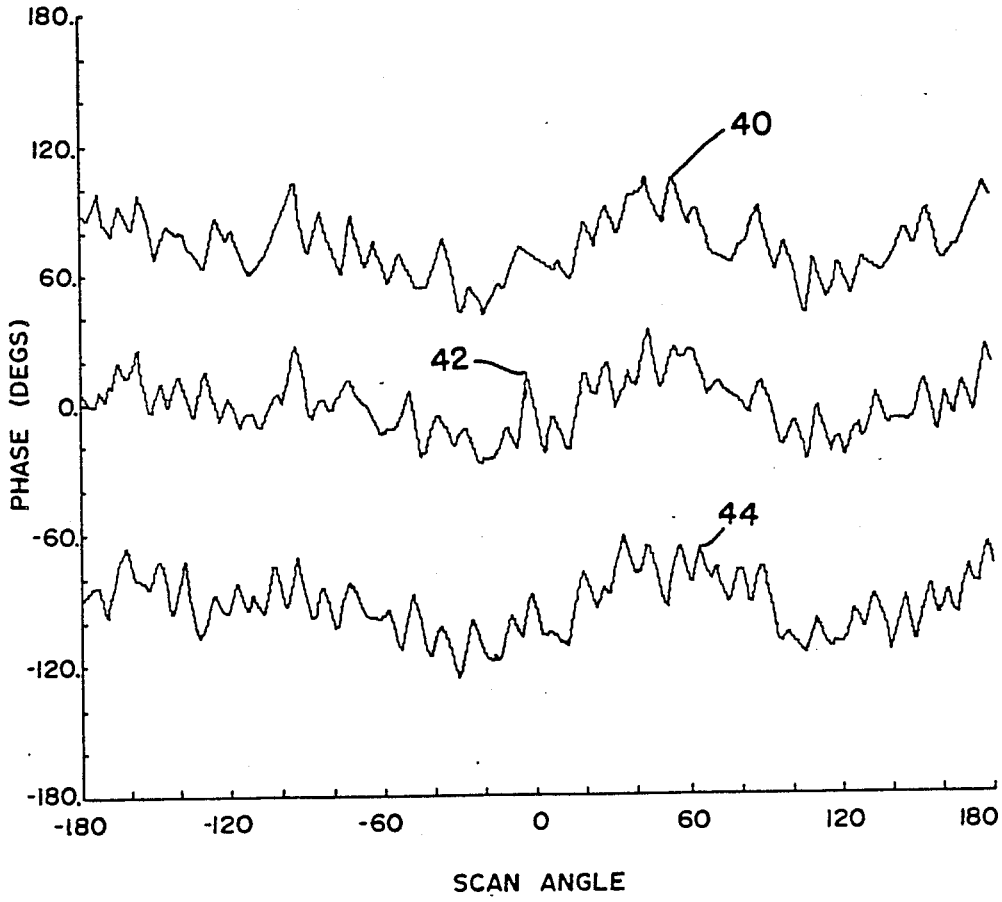
FIG. 4 illustrates the variation of phase angle with scan angle over the operating frequency band of an S-band embodiment of the present invention.
Figure 5:
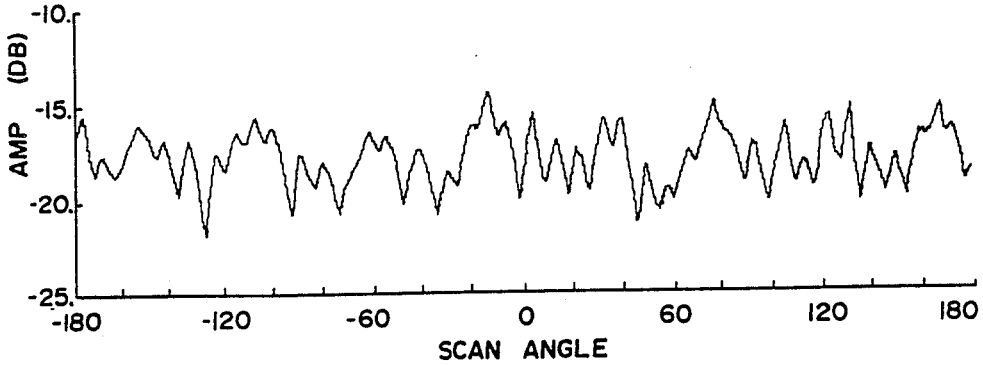
FIGS. 5, 6, and 7 are far field plots illustrating the amplitude pattern over the operating frequency band of the S-band embodiment.
Figure 6:
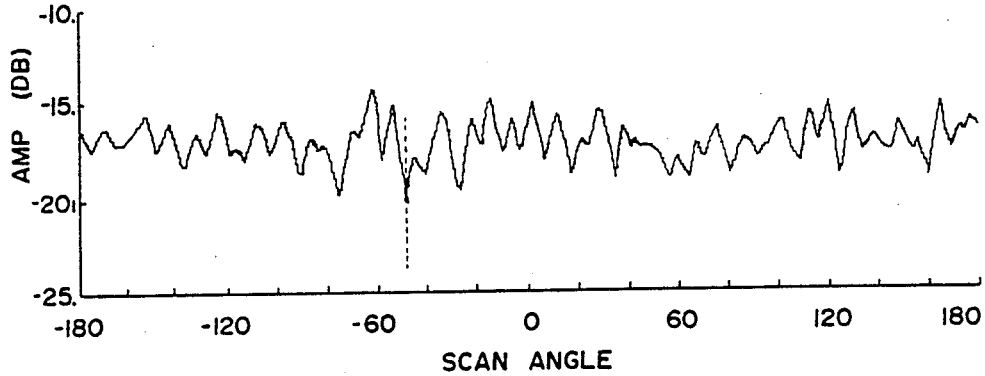
Figure 7:
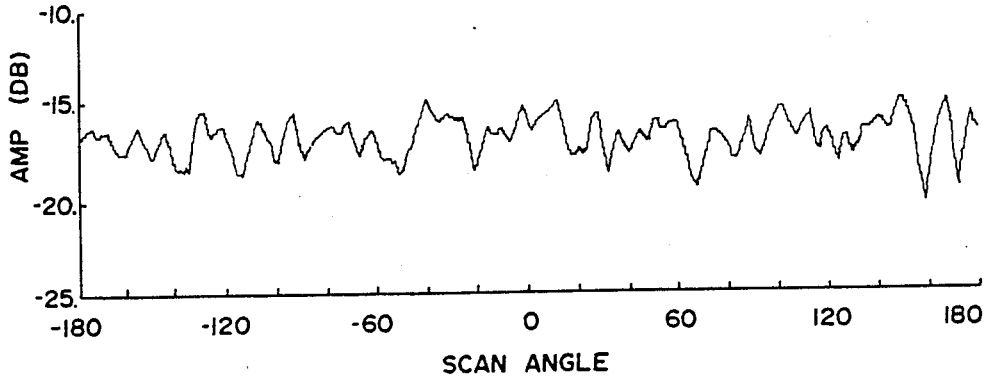

FIGS. 4–7 shows broadside roll plane patterns at the low end, the middle and the upper end of operating band of the antenna. In FIG. 4, curves 40, 42, and 44 are plots of phase versus scan angle for 2200 MHz, 2245 MHz, and 2290 MHz, respectively. The curves 40, 42, and 44 have an underlying bias due to the fact that the measuring apparatus was slightly out of round. FIGS. 5, 6, and 7 are plots of amplitude versus scan angle for 2200 mhz, 2245 MHz, and 2290 MHz, respectively.

Figure 8:
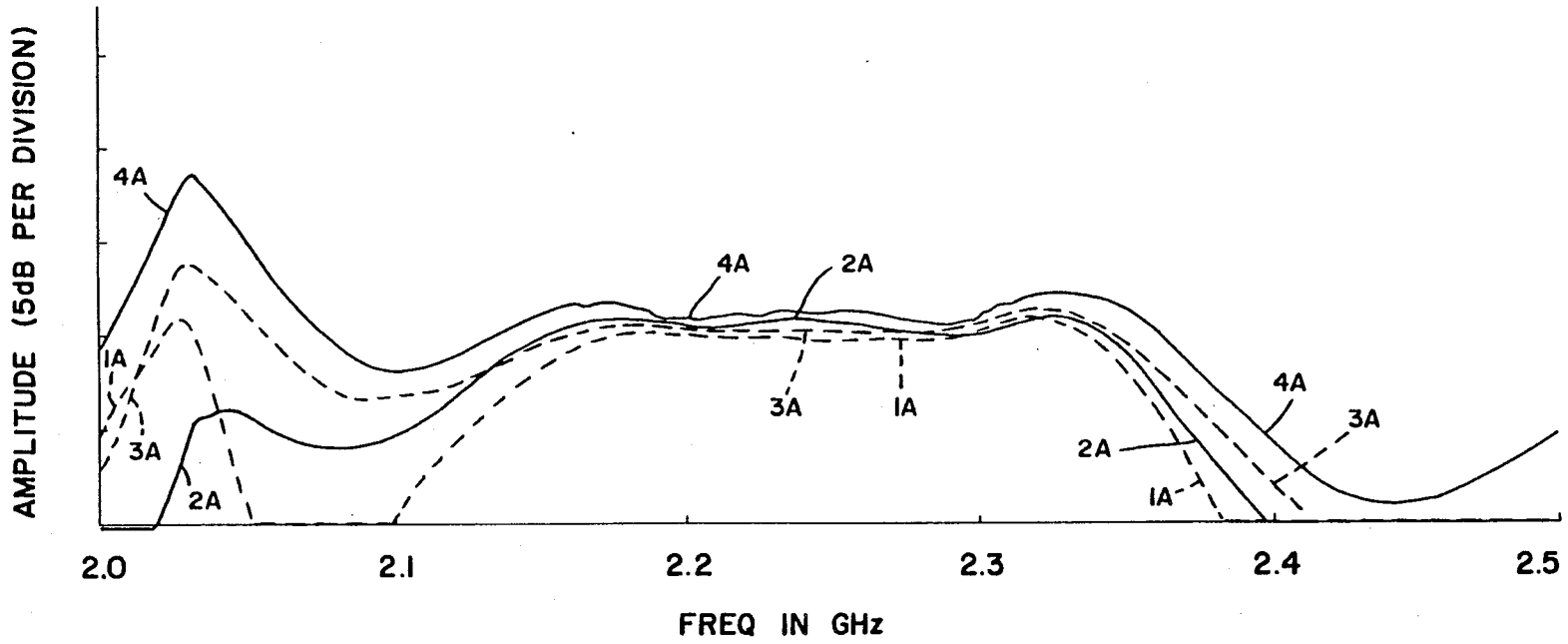
FIGS. 8 and 9 illustrate the variation of amplitude and phase respectively, with frequency at each slot for the S-band embodiment.
Figure 9:
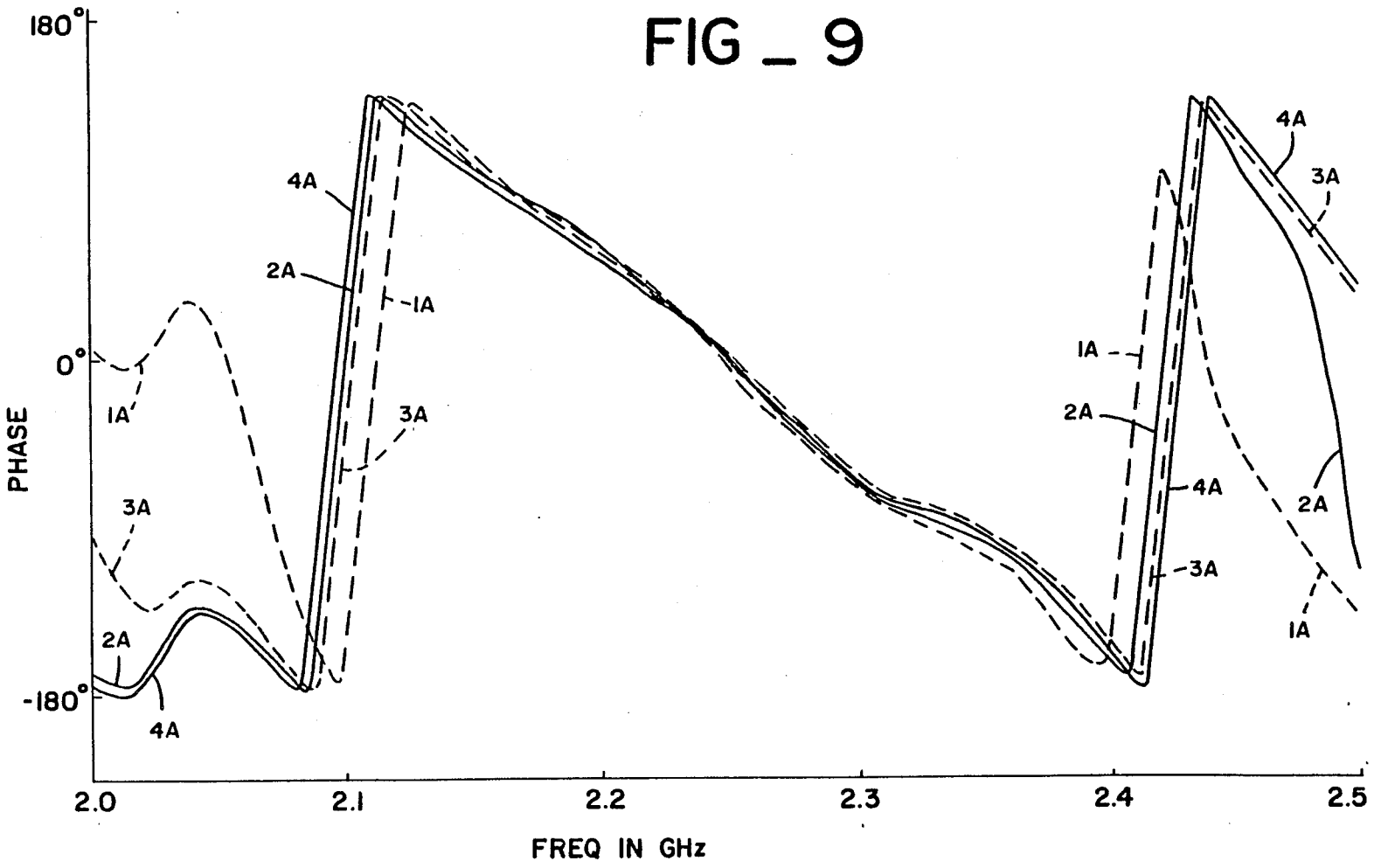

FIGS. 8 and 9 illustrate the variation of amplitude and phase with frequency at each slot for ridge gap of 0.156 inches. For clarity, FIGS. 8 and 9 show the phase and amplitude measured at the four slots (1A, 2A, 3A, and 4A) on the right side (in FIG. 3*a*) of a radiator; the corresponding slots on the left have a similar phase and amplitude characteristic. As shown in FIGS. 8 and 9, the S-band antenna provided a substantially constant phase and amplitude from slot to slot for any given frequency within the operating bandwidth. Changing the ridge gap (d) from the preferred dimension causes the phase to vary from slot to slot within the operating bandwidth. Changes in the size of the ridge gap also cause the amplitude to vary from slot to slot with frequency. It can be seen from FIGS. 4–9 that the described antenna provides broadband omnidirectional coverage.

Obviously many modification and variations of the present invention are possible in the light of the above teachings. It is therefore to be understood that within the scope of the appended claims the invention may be practiced otherwise than as specifically described.

What is claimed is:

1. An antenna for providing a omnidirectional circumferential radiation pattern, which comprises:

(a) a plurality of arcuate waveguide radiators disposed end-to-end to form a cylindrical antenna;

(b) each said arcuate waveguide radiator having a closed arcuate waveguide cavity of rectangular cross-section, an outer side wall of each said cavity having a plurality of longitudinal slots, an inner side wall of each said cavity having a central longitudinal ridge; and (c) means for feeding connected to each of said arcuate waveguide radiators, said means for feeding being coupled through the inner side wall of each said cavity to a feedpoint at the center of the outer side wall of said cavity.

2. An antenna as recited in claim 1 wherein said slots are nominally of a length equal to one-half the wavelength in air at the center operating frequency of the antenna.

3. An antenna as recited in claim 2 wherein said slots are disposed uniformly in the longitudinal direction.

4. An antenna as recited in claim 3 wherein said slots are disposed in two parallel rows which are equidistant from a longitudinal centerline of said outside wall, the slots adjacent to the feedpoint being on the same side of the longitudinal centerline, adjacent slots on each side of the longitudinal centerline being in different rows.

5. An antenna as recited in claim 4 wherein said slots are each of a length approximately equal to 1.1 times the wavelength in air at the center operating frequency of the antenna.

* * * * *